United States Patent [19]

Nakao et al.

[11] 4,235,326

[45] Nov. 25, 1980

[54] MAIN FRAME CONSTRUCTION OF CONVEYOR

[75] Inventors: Toshiharu Nakao; Katsuya Teranishi; Makoto Kawagoshi, all of Katsuta, Japan

[73] Assignees: Hitachi, Ltd.; Hitachi-Mito Kogyo, Ltd., both of Japan

[21] Appl. No.: 718,010

[22] Filed: Aug. 26, 1976

[30] Foreign Application Priority Data

Sep. 10, 1975 [JP] Japan ..... 50-108887

[51] Int. Cl.[3] ..... B66B 9/14

[52] U.S. Cl. ..... 198/326; 198/335

[58] Field of Search ..... 198/326, 327, 329, 330, 198/321, 332, 333, 335, 838, 845

[56] References Cited

U.S. PATENT DOCUMENTS

| | | | |
|---|---|---|---|
| 951,744 | 3/1910 | Seeberger | 198/326 |
| 1,851,380 | 3/1932 | Briggs | 198/838 |
| 2,039,994 | 5/1936 | Herker | 198/332 |
| 2,656,031 | 10/1953 | Masek | 198/332 |
| 3,107,778 | 10/1963 | Jordan | 198/840 X |

FOREIGN PATENT DOCUMENTS

| | | | |
|---|---|---|---|
| 1274286 | 8/1968 | Fed. Rep. of Germany | 198/338 |
| 6612032 | 10/1967 | Netherlands | 198/321 |
| 698747 | 10/1953 | United Kingdom | 198/326 |

*Primary Examiner*—James L. Rowland

*Attorney, Agent, or Firm*—Craig & Antonelli

[57] ABSTRACT

A conveyor, in which continuous flights of steps in an endless form are guided by means of guide tracks, and a pair of handrails in an endless form are provided on each side of the flights of steps thereabove and moved at the same speed and in the same direction as those of the flights of steps. This conveyor includes: a pair of main frame bodies each consisting of a vertical member which is formed integrally with upper and lower horizontal members which extend from the top and bottom edges thereof in the horizontal direction, respectively; and transverse beams interconnecting the upper horizontal members of the aforesaid main frame bodies, and connecting members interconnecting the lower horizontal members of the main frame bodies at suitable points along the length of a conveyor. The pair of main frame bodies are positioned on each side of the aforesaid endless flights of steps, respectively.

2 Claims, 3 Drawing Figures

MAIN FRAME CONSTRUCTION OF CONVEYOR

This invention relates to a main frame construction of a conveyor, such as an escalator.

The construction of an escalator typical of conveyors is such that continuous flights of steps in an endless form are provided between a pair of balustrade constructions on each side of the steps, and the aforesaid steps are driven by means of upper and lower drive means, while being guided by guide tracks on their upper line as well as by another guide tracks on their return so as to travel on the aforesaid guide tracks. In addition, a pair of endless handrails travel on the top surfaces of the balustrade constructions on their upper line, and are guided by a plurality of guide rollers on their return. In this respect, the endless handrails travel at the same speed and in the same direction as those of the aforesaid endless steps.

With the escalator of the type described, a main frame bodies are housed within a pair of balustrade constuctions, while the aforesaid main frame bodies consists, on each side thereof, of an upper main member, a lower main member and subsidiary members interconnecting the aforesaid upper member and lower member, thereby providing a truss construction. In addition, track supporting frames interconnecting the subsidiary members on each side of the steps, and track supporting members protruding from the subsidiary members are secured to the aforesaid subsidiary members positioned on each side of the steps. Said supporting frames support tracks which guide the upper run of the steps and said protruding track supporting members support tracks which guide the lower run of the steps. Step-supporting wheels attached to the side edges of the steps travel on the tracks by means of an endless chain which interconnects the flights of steps in an endless form. Guide rollers for the aforesaid handrails are supported by guide-roller-supporting members secured to the subsidiary members of the main frame bodies and guide the handrails on their return. In addition, the lower members of the main frame bodies are interconnected by connecting members. An oil pan is secured to the aforesaid connecting members for receiving oil from step-chains and tracks and dust from passengers.

With the aforesaid escalator, the main frame body is made by welding the aforesaid upper main members, lower main members and subsidiary members in a manner to provide a truss construction. In other words, the main frame body consists of individual members, resulting in an increase in the number of parts. In addition to this, the lengths of the subsidiary members are varying depending on their uses, such as for upper and lower, horizontal-entrance-and-exit portions, and for an intermediate, inclined portion of an escalator. This dictates the use of subsidiary members having varying lengths and sizes, thus rendering the construction of the main frame body complicated and incurring dimensional errors upon assembly, because of welding of individual members. As a result, there is required expenditure of much time and efforts for eliminating the aforesaid dimensional errors in assembly and controlling of varying parts required. Yet furthermore, the aforesaid supporting frames and supporting members are also formed by securing individual parts to the subsidiary members by welding, thus resulting in shortcomings similar to the preceding case.

Meanwhile, for smooth transportation of passengers or users and hence smooth travelling of endless flights of steps, there is required a considerably high accuracy in attachment of tracks. However, these tracks should be mounted on supporting frames and supporting members therefor in main frame bodies, and subsidiary members, so that there results difficulty in assembly of these tracks in a narrow space within the main frame bodies, with the accompanying poor operational efficiency and considerable expenditure of time and efforts in adjustment of the relative positions or dimensions of the respective tracks.

Meanwhile, the function and mission of guide rollers for use with handrails are not only to support handrails but also to prevent their zigzag movement or travelling for achieving smooth travelling of the handrails. However, according to the prior art escalator, the guide rollers are mounted in a narrow space within main frame bodies, thus resulting in difficulty in accurate location of guide rollers, which in turn leads to a failure to achieve smooth travelling of handrails.

It is an object of the present invention to provide a main frame construction for a conveyor, which allows ready assembly and adjustment according to a simple construction thereof.

According to the present invention, there is provided a main frame construction for a conveyor, which comprises: main frame bodies positioned or housed on each side of continuous flights of steps of an endless form along the entire lengths thereof, the aforesaid main frame bodies including vertical members which are integrally formed with upper and lower, horizontal members which extend from the top and bottom edges of the vertical members in the horizontal direction, respectively; and transverse beams interconnecting the aforesaid upper horizontal members; and connecting members interconnecting the aforesaid lower horizontal members at suitable points along the length of a conveyor.

Figure 1:
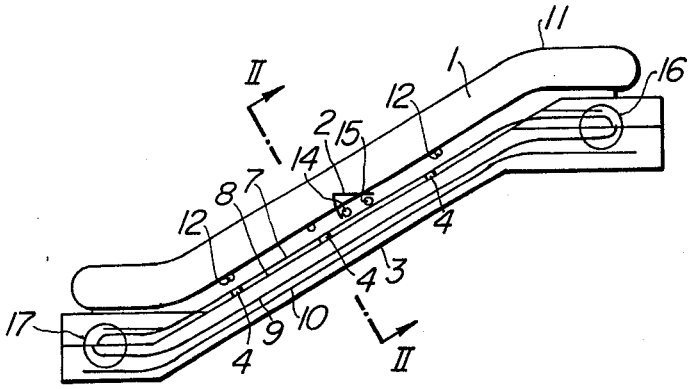
FIG. 1 is a side view of an escalator, showing one embodiment of the invention.

Referring to FIG. 1, there is shown an outline of an escalator according to the present invention. Continuous, endless flights of steps 2 are driven by means of an upper drive means or an upper sprocket 16 and a lower drive means or a lower sprocket 17, and guided by guide tracks 7, 8 on their upper line, as well as by guide tracks 9, 10 on their return. Thus, wheels attached to the side edges of the steps roll on the tracks 7, 8, and 9, 10. In addition, a pair of handrails of an endless form are guided by means of balustrade constructions 1 on their upper line and by means of guide rollers 12 on their return and travel at the same speed and in the same direction as those of the aforesaid flights of steps of an endless form.

Figure 2:
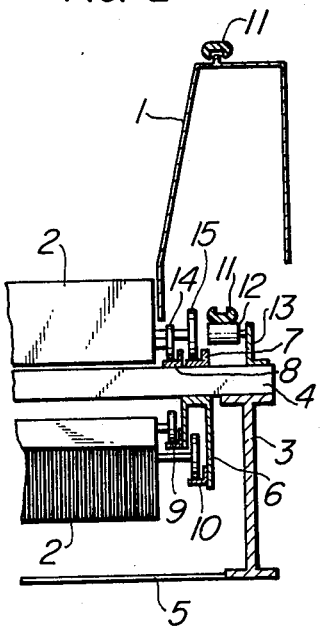
FIG. 2 is a partial cross-sectional view taken along the line II—II of FIG. 1.

FIG. 2 shows an essential part of the escalator according to the present invention. FIG. 2 is a partial, enlarged cross-sectional view of the escalator, taken along the line II—II of FIG. 1. In this respect, only a righthand half is shown, because of symmetry of the construction.

Referring to FIG. 2, there is shown a main frame body 3, which is provided in the form of a 'I' beam having a 'I' shaped cross-section. The main frame bodies 3 are positioned on each side of the steps along the entire length of an escalator within each side of balustrade constructions 1,1, respectively. The main frame member 3 includes a vertical member formed with upper and lower, horizontal members at the top and bottom edges of the vertical member, integrally. Transverse beams 4 interconnect the upper horizontal members of the main frame bodies, 3,3, while reinforcing connecting members 5 interconnect the lower horizontal members of the main frame bodies 3,3 at suitable positions along the length of an escalator, thus presenting a box type construction for a main frame of the escalator. A track supporting member 6 is secured to the aforesaid transverse beam 4. The guide tracks 7, 8 for an advancing run are secured to the transverse beam 4, while the guide tracks 9, 10 for a return run are secured to the supporting member 6. In addition, guide roller 12 is adapted to guide the handrail 11 on its return run and attached through the medium of a guide-roller supporting member 13 to the transverse beams 4.

Step-supporting wheels 14, 15 attached to the sides of the steps 2 which are driven by upper and lower sprockets roll on the rails 7 to 10, while the handrails 11 run on the guide rollers 12.

With this embodiment, the main frame bodies 3 made of a 'I' section steel are provided, while the transverse beams 4 and reinforcing connecting members 5 are secured to the upper horizontal members and lower horizontal members of the main frame bodies 3, respectively, thereby avoiding the use of a prior art main frame body of a truss construction. In other words, the upper and lower horizontal members are formed integrally with the vertical members as the bodies 3, thus permitting simple assembly thereof. In addition, desired rigidity may be achieved for the main frame assembly of an escalator, because of its box type construction, in which the transverse beams 4 interconnect the upper horizontal members of the main frame bodies 3 positioned on each side of the steps and the reinforcing connecting members 5 interconnect the lower horizontal members of the main frame bodies 3 in a like manner. As a result, the construction of a main frame assembly is simple. In addition, accuracy in dimension upon assembly of a main frame of an escalator is only required for transverse beams 4 for securing the tracks 7 and 10 thereto, and the upper horizontal members of the main frame bodies. This allows simple or easy assembly and adjustment in dimension. The track supporting member 6 for supporting tracks 9 and 10 is used commonly, rather than supporting same individually. This enhances efficiency of attaching the supporting member 6.

According to the prior art construction, tracks 7, 10 are individually mounted on the main frame bodies and adjusted for positions individually. In contrast thereto, according to the present embodiment, the tracks 9, 10 and supporting member 6, or tracks 7 to 10, supporting member 6, and transverse beams 4 may be assembled and adjusted for dimensions outside the main frame bodies, after which the track assembly may be set in the main frame bodies 3, thus allowing easy dimensional adjustment and assembly, with the accompanying enhanced efficiency of operations. Yet furthermore, the guide rollers 12 for guiding the handrails 11 on their return run are positioned on the top edge of the transverse beams 4, so that there may be achieved easy attachment and dimensional adjustment for the guide rollers 12. Thus, the handrails 11 may travel smoothly.

Figure 3:
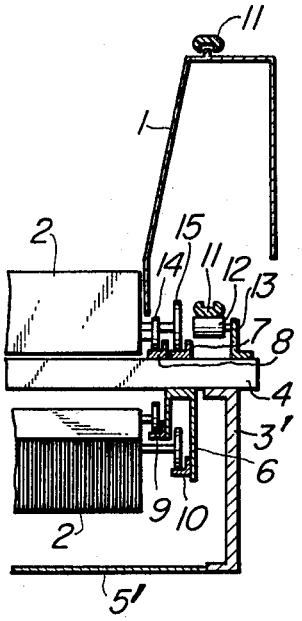
FIG. 3 is a partial cross-sectional view of one modification of the present invention, which corresponds to the partial cross-sectional view of FIG. 2 taken along the line II—II of FIG. 1.

With the foregoing embodiment the main frame body 3 is made of a 'I' section steel, while FIG. 3 shows another embodiment in which the main frame body is made of a channel 3' having a 'U' shaped cross section, whose openside may be directed outwardly or inwardly. In addition, transverse beams 4 are secured to the upper flange portions of the main frame bodies 3' so as to interconnect same, while an oil pan 5' secured to the lower flange thereof along the entire length of an escalator, thereby providing a box type construction having a bottom portion adapted to collect oil. Like parts are designated like reference numerals throughout FIGS. 2 and 3.

Alternatively, the guide-roller-supporting member 13 may be directly secured to an upper flange portion of the main frame body 3. While the foregoing description has been given of an escalator, the present invention may be applied to any type of conveyors, such as an electrically driven road and the like.

As is apparent from the foregoing description, a main frame assembly according to the present invention is extremely rigid and strong, while presenting a simple internal construction for a conveyor and allowing simple attachment and dimensional adjustment of the respective components, such as handrail-guide rollers, tracks and the like. Thus, there may be achieved improved rapidness in installation of a conveyor, with accompanying lowered cost of installation of the conveyor.

What is claimed is:

1. A main frame construction of a conveyor comprising:

continuous flights of steps in an endless form;

guide tracks for guiding said steps;

endless handrails moving at the same speed and in the same direction as those of said steps;

main frame bodies consisting of vertical members, and upper and lower horizontal members which are integral with each of said vertical members, respectively, said main frame bodies being positioned on each side of said continuous flights of steps of an endless form, respectively;

transverse beams interconnecting said upper horizontal members of said main frame bodies; and connecting members interconnecting said lower horizontal members of said main frame bodies, said main frame bodies, transverse beams and connecting members being combinedly constructed to provide a structure having a box-like cross-section, wherein a plurality of guide rollers are positioned on said upper horizontal members of said main frame bodies, for guiding said handrails on their return run.

2. A main frame construction of a conveyor comprising:

continuous flights of steps in an endless form;

guide tracks for guiding said steps;

endless handrails moving at the same speed and in the same direction as those of said steps;

main frame bodies consisting of vertical members, and upper and lower horizontal members which are integral with each of said vertical members, respectively, said main frame bodies being positioned on each side of said continuous flights of steps of an endless form, respectively;

transverse beams interconnecting said upper horizontal members of said main frame bodies; and connecting members interconnecting said lower horizontal members of said main frame bodies;

said main frame bodies, transverse beams and connecting members being combinedly constructed to provide a structure having a box-like cross-section, wherein a plurality of guide rollers are positioned on said transverse beams, for guiding said handrails on their return run.

* * * * *